US008419488B2

(12) United States Patent
Ooshita et al.

(10) Patent No.: US 8,419,488 B2
(45) Date of Patent: Apr. 16, 2013

(54) STEERING APPARATUS FOR OUTBOARD MOTOR

(75) Inventors: Sachio Ooshita, Yokohama (JP); Yoshihiro Makita, Yokohama (JP)

(73) Assignee: NHK MEC Corporation, Yokohama-Shi (JP)

( * ) Notice: Subject to any disclaimer, the term of this patent is extended or adjusted under 35 U.S.C. 154(b) by 0 days.

(21) Appl. No.: 13/220,468

(22) Filed: Aug. 29, 2011

(65) Prior Publication Data

US 2012/0040572 A1 Feb. 16, 2012

Related U.S. Application Data

(63) Continuation of application No. PCT/JP2011/060535, filed on May 2, 2011.

(30) Foreign Application Priority Data

Aug. 13, 2010 (JP) ..... 2010-181353

(51) Int. Cl.
*B63H 20/08* (2006.01)
*B63H 25/10* (2006.01)

(52) U.S. Cl.
USPC ..... 440/59; 114/144 R

(58) Field of Classification Search ..... 440/53, 440/55, 58, 59, 60, 62, 63, 61 T; 114/144 R
See application file for complete search history.

(56) References Cited

U.S. PATENT DOCUMENTS 5,244,426 A 9/1993 Miyashita et al.
6,398,601 B1 * 6/2002 Oguma ..... 440/53
7,156,034 B2 1/2007 Mizutani
7,681,513 B1 * 3/2010 Hundertmark ..... 114/150
7,844,374 B2 * 11/2010 Mizutani ..... 701/21
2010/0120303 A1 5/2010 Murai et al.

FOREIGN PATENT DOCUMENTS

JP 6-156386 A 6/1994
JP 2748559 B2 5/1998
JP 2959044 B2 10/1999
JP 2005-254850 A 9/2005
JP 2006-160213 A 6/2006
JP 2007-203839 A 8/2007

(Continued)

OTHER PUBLICATIONS

International Search Report (ISR) dated Aug. 9, 2011 in counterpart International Application No. PCT/JP2011/060535.

(Continued)

*Primary Examiner* — Lars A Olson
*Assistant Examiner* — Anthony Wiest
(74) *Attorney, Agent, or Firm* — Holtz, Holtz, Goodman & Chick, P.C.

(57) ABSTRACT

Support arms are disposed on a tilting shaft on a bracket of an outboard motor. An electric actuator is mounted between the support arms. The electric actuator includes a cover member, first and second electric motors disposed individually on the opposite ends of the cover member, a feed screw configured to be rotated by the electric motors, a nut member configured to move along an axis as the feed screw rotates, a drive arm configured to move integrally with the nut member and transversely relative to the boat body, and protective boots. The drive arm is connected to a steering arm through an engaging member. If the drive arm moves in the direction of the axis along the cover member, the steering angle of the steering arm changes depending on the degree of movement of the drive arm.

11 Claims, 14 Drawing Sheets

FOREIGN PATENT DOCUMENTS

| | | | | |
|---|---|---|---|---|
| JP | 2007-203845 | A | | 8/2007 |
| JP | 2007-203847 | A | | 8/2007 |
| JP | 2007203845 | A | * | 8/2007 |
| JP | 2010-173446 | A | | 8/2010 |

OTHER PUBLICATIONS

International Search Report (ISR) dated Aug. 9, 2011 (in English) issued in parent International Application No. PCT/JP2011/060535.

* cited by examiner

STEERING APPARATUS FOR OUTBOARD MOTOR

CROSS-REFERENCE TO RELATED APPLICATIONS

This application is a Continuation Application of PCT Application No. PCT/JP2011/060535, filed May 2, 2011 and based upon and claiming the benefit of priority from prior Japanese Patent Application No. 2010-181353, filed Aug. 13, 2010, the entire contents of all of which are incorporated herein by reference.

BACKGROUND OF THE INVENTION

1. Field of the Invention

This invention relates to a steering apparatus for an outboard motor comprising an electric actuator unit.

2. Description of the Related Art

Conventionally, there has been known a steering apparatus for an outboard motor in which a hydraulic pump is provided on, for example, a helm (steering wheel), and a hydraulic actuator configured to be driven by the hydraulic pump is disposed near the outboard motor. In this steering apparatus, an oil pressure produced by the hydraulic pump serves to redirect the outboard motor. Also known is a mechanical steering apparatus that redirects an outboard motor by transmitting a rotary motion of a helm to the outboard motor through a push-pull cable. Since these steering apparatuses are operated manually (or by an operator's power), they require a considerably large operating force, depending on the boat operating conditions, and hence, leave room for improvement.

Thus, as disclosed in, for example, Japanese Patent No. 2959044 (Patent Document 1), a steering apparatus may be contrived such that an electric actuator unit is used as a drive source for steering. The steering apparatus of Patent Document 1 comprises a rack extending transversely relative to a boat body, pinion meshing with the rack, rack case that accommodates the pinion, electric motor for rotating the pinion, and gear mechanism for transmitting a rotational force of the electric motor to the pinion. When the pinion is rotated by the electric motor, the pinion and rack case move longitudinally relative to the rack. The outboard motor can be redirected as the movement of the rack case is transmitted to the outboard motor through a transmission mechanism comprising a guide plate. According to the electric steering apparatus of this type using the electric motor for steering, its helm requires only a small operating force, so that a burden on an operator can be reduced.

In the electric steering apparatus using the rack and pinion, as described in Patent Document 1, the pinion, gear mechanism, and drive system components, such as the electric motor, project outside the rack, so that the longitudinal dimension and the like are large. The steering apparatus of this type has a problem that various cables, fuel supply pipe, etc., attached to the outboard motor are likely to interfere with the drive system components.

In addition, protective boots (bellow tubes) for waterproofing a fitting portion between the rack and pinion are exposed to the outside. Therefore, the cables, fuel supply pipe, etc., may possibly contact the protective boots. In some cases, the protective boots may be damaged and leave the rack and pinion to be eroded by seawater or the like. As the drive system components pivot downwardly when the outboard motor is tilted up, moreover, the greatly projecting drive system components are likely to interfere with members on the boat body, thus leaving room for improvement.

BRIEF SUMMARY OF THE INVENTION

Accordingly, the object of this invention is to provide a steering apparatus for an outboard motor configured so that an electric actuator unit can be formed in a compact manner and damage to protective boots can be prevented.

A steering apparatus according to the present invention is a steering apparatus comprising an actuator unit configured to redirect a steering arm of an outboard motor. The actuator unit comprises first and second support arms supported on a bracket used to mount the outboard motor on a boat body, a cover member disposed between the first and second support arms, a first electric motor disposed on one end of the cover member and secured to the first support arm, a second electric motor disposed on the other end of the cover member and secured to the second support arm, a feed screw disposed along the cover member inside the cover member and configured to be rotated by respective torques of the first and second electric motors, a nut member threadedly engaged with the feed screw and configured to move along an axis of the feed screw inside the cover member as the feed screw rotates, a drive arm attached to the nut member and configured to transmit the movement of the nut member along the axis to the steering arm, and protective boots disposed inside the cover member. The protective boots cover the feed screw in such a manner that the protective boots can expand and contract along the axis of the feed screw.

In one embodiment of the present invention, the first and second support arms are mounted on a tilting shaft of the outboard motor and the actuator unit pivots downwardly about the tilting shaft with the outboard motor tilted up.

Further, elastic members with a high spring constant, such as coned disc springs, should preferably be disposed between the tilting shaft and the first and second support arms. Furthermore, elastic members may be disposed between the electric actuator and the first and second support arms.

In one embodiment of the present invention, moreover, the actuator unit comprises a neutral position sensor for detecting a neutral position of the steering arm. Further, the actuator unit may comprise a steering angle sensor for detecting a steering angle of the steering arm.

According to the present invention, the feed screw can be rotated in such a manner that torques are applied to the feed screw through its opposite ends by means of the pair of electric motors. Therefore, the outside diameter of the feed screw can be reduced compared with the case of a conventional actuator unit in which a feed screw is rotated by a single motor. In addition, the feed screw and protective boots are concentrically arranged inside the cover member, and the electric motors are disposed individually at the opposite ends of the feed screw. Thus, the radial dimension of the electric actuator can be made compact. Since the protective boots are protected by the cover member, moreover, the protective boots can be prevented from being damaged by contacting the members around the actuator unit.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

A boat comprising a steering apparatus according to a first embodiment of the present invention will now be described with reference to FIGS. 1 to 12.

Figure 1:
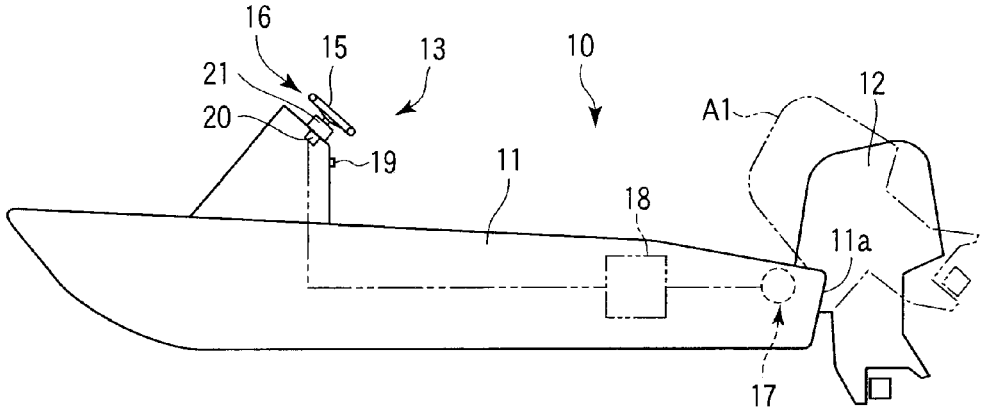
FIG. 1 is a side view of a boat comprising a steering apparatus according to a first embodiment of the present invention.
Figure 2:
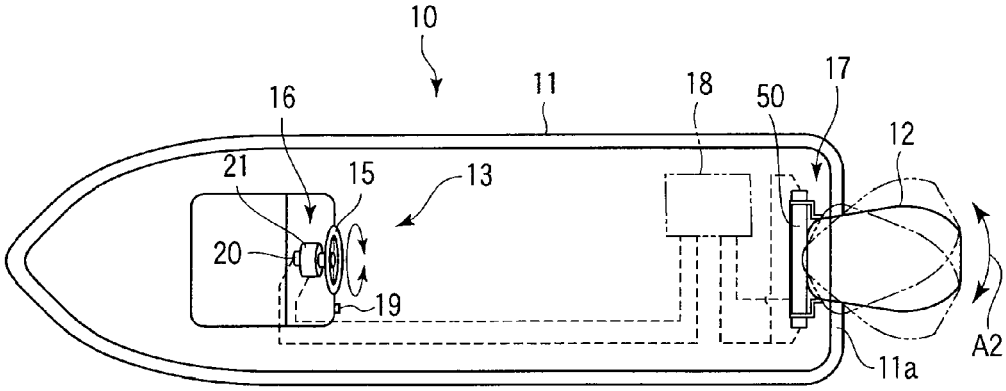
FIG. 2 is a plan view of the boat shown in FIG. 1.

FIGS. 1 and 2 show an example of a boat 10. The boat 10 comprises a boat body 11, outboard motor 12, and steering apparatus 13. The outboard motor 12 can be tilted up, as indicated by two-dot chain line A1 in FIG. 1. Further, the outboard motor 12 can turn to starboard and port, as indicated by arrow A2 in FIG. 2. The steering apparatus 13 comprises a helm device 16 comprising a helm 15, electric actuator unit 17 disposed at the rear part of the boat body 11, control unit 18, etc. The actuator unit 17 functions as a drive source for changing the steering angle of the outboard motor 12. The control unit 18 electrically controls the actuator unit 17. This control unit 18 is configured to be turned on and off by a power switch 19.

The helm device 16 comprises a helm sensor 20, friction mechanism 21, etc. An example of the helm sensor 20 comprises an encoder for detecting the operating angle of the helm 15 and outputs an electrical signal corresponding to the operating angle of the helm 15 to the control unit 18. The friction mechanism 21 comprises a variable brake mechanism, which can change the resisting power (steering power) produced when an operator rotates the helm 15.

Figure 3:
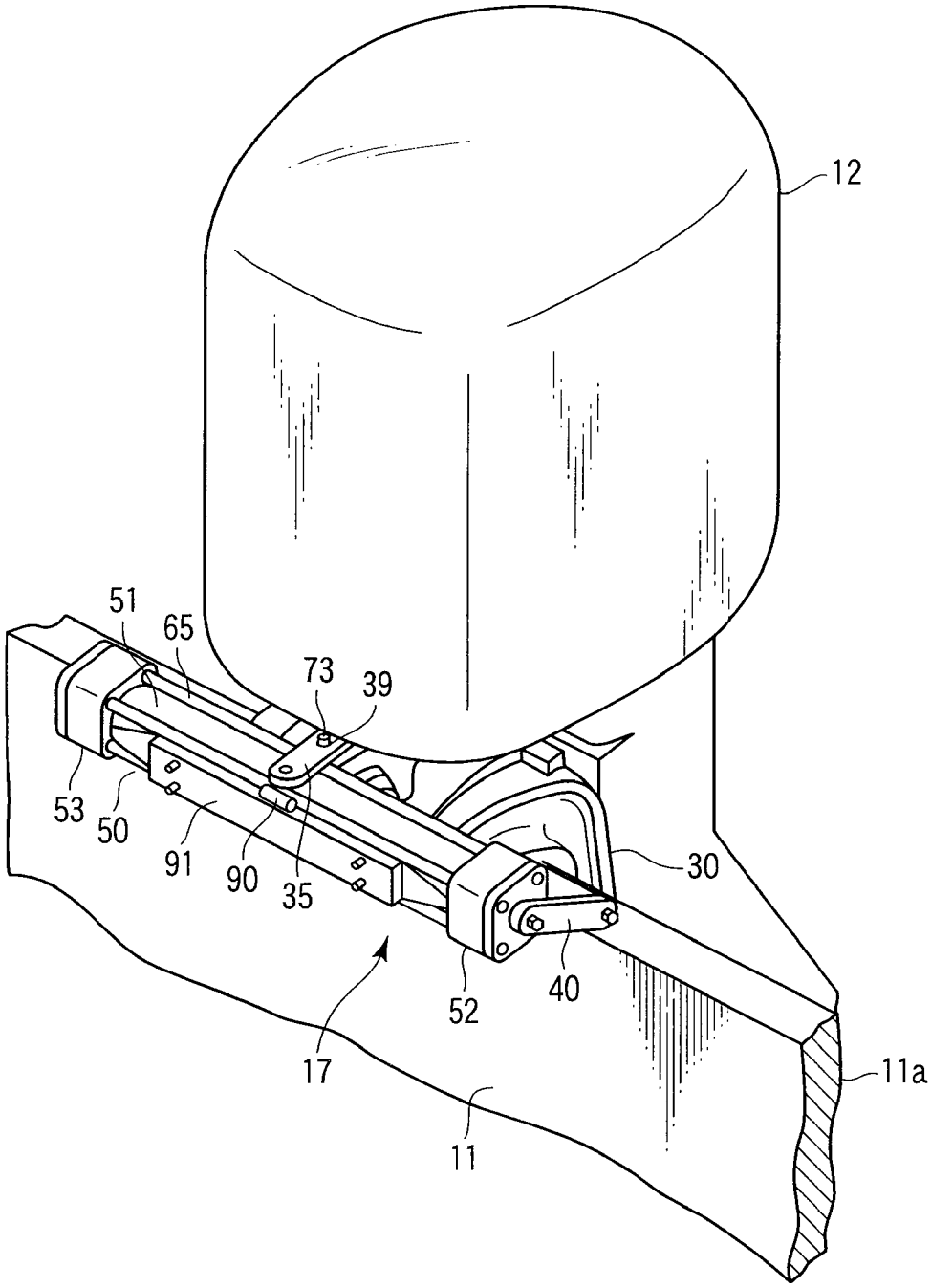
FIG. 3 is a perspective view showing a part of an outboard motor and an actuator unit of the boat shown in FIG. 1.
Figure 4:
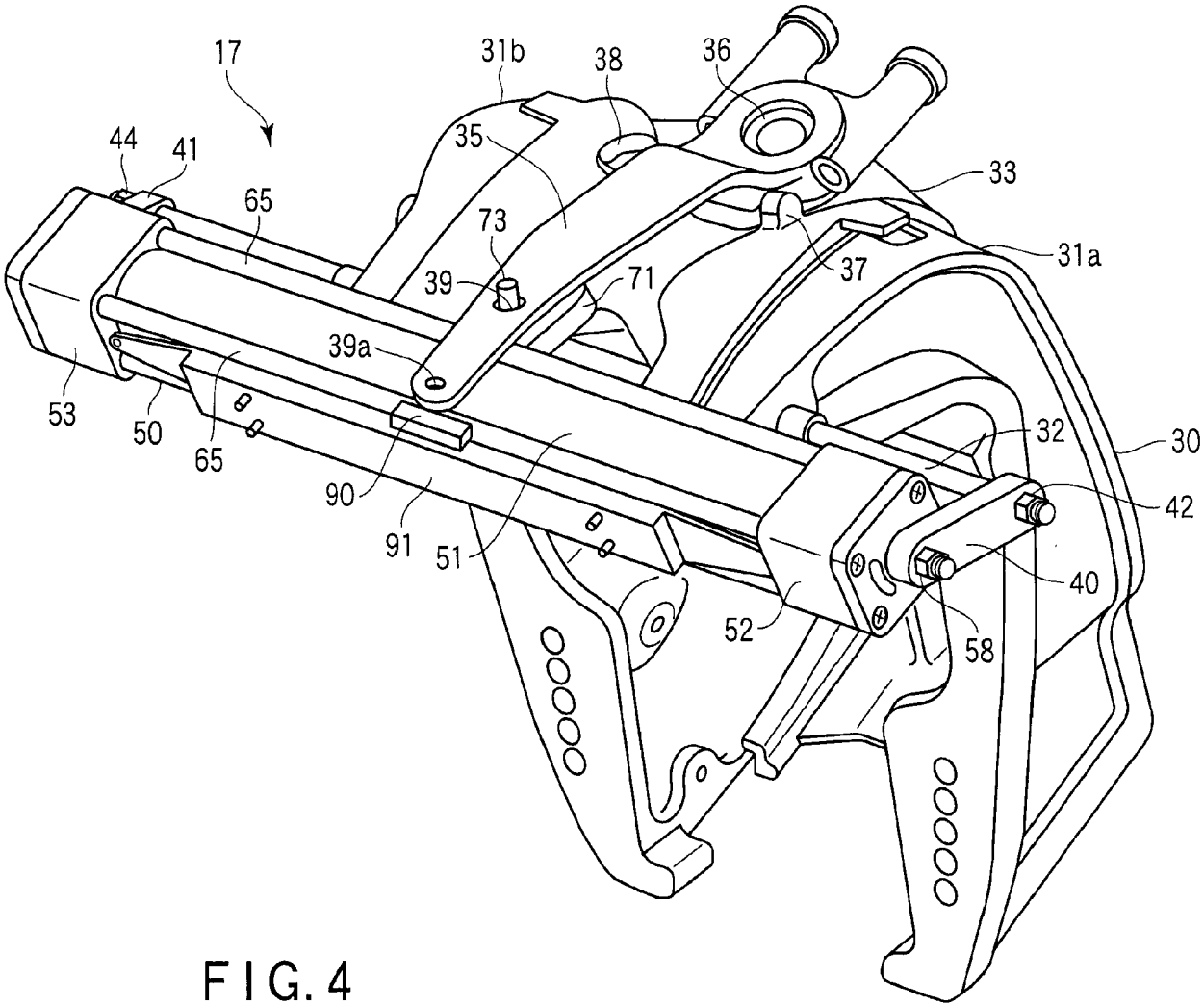
FIG. 4 is a perspective view of the actuator unit and a bracket shown in FIG. 3.
Figure 5:
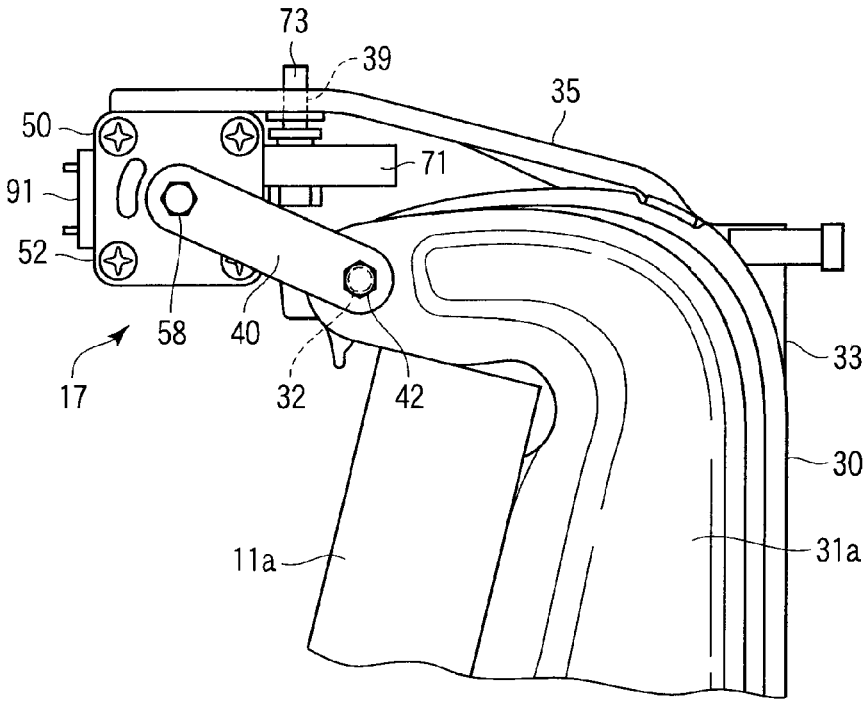
FIG. 5 is a side view showing the actuator unit and an upper part of the bracket shown in FIG. 3.
Figure 6:
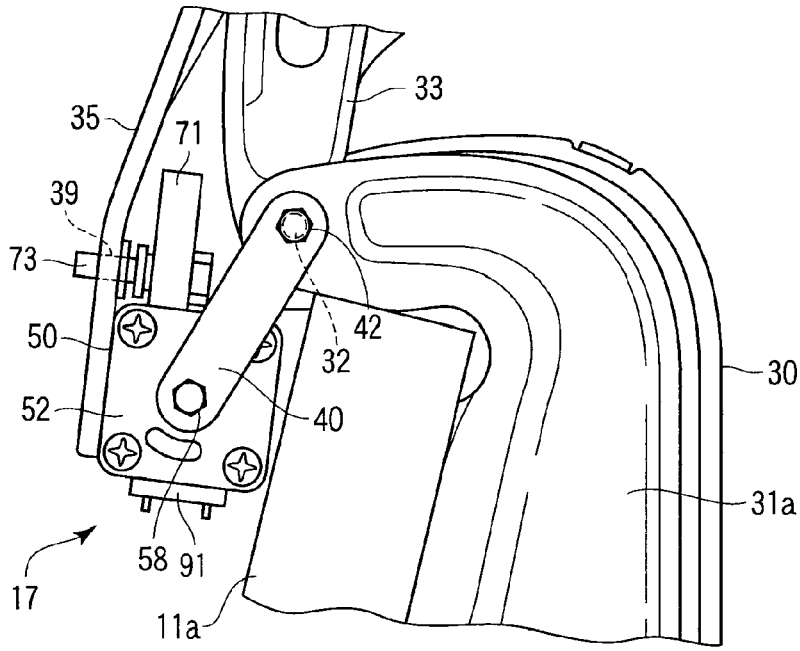
FIG. 6 is a side view showing a tilted-up state of the bracket shown in FIG. 3.

FIG. 3 shows a part of the outboard motor 12 and the actuator unit 17. The outboard motor 12 is supported on a rear wall 11*a* of the boat body 11 by a bracket 30. FIG. 4 is a perspective view showing the actuator unit 17 and bracket 30. The bracket 30 comprises fixed bracket portions 31*a* and 31*b* secured to the boat body 11 and a movable bracket portion 33. The movable bracket portion 33 is movable vertically relative to the fixed bracket portions 31*a* and 31*b* about a tilting shaft 32. The tilting shaft 32 is a shaft that serves as a center around which the outboard motor 12 is tilted up. The tilting shaft 32 extends transversely or horizontally relative to the boat body 11.

The outboard motor 12 is mounted on the movable bracket portion 33. The movable bracket portion 33 can be vertically moved between a tilted-down position shown in FIG. 5 and a tilted-up position shown in FIG. 6 by a tilt drive mechanism such as a hydraulic actuator (not shown). Thus, the outboard motor 12 has a tilt-up function.

The movable bracket portion 33 comprises a steering arm 35 for changing the steering direction of the outboard motor 12. The steering arm 35 can be pivoted laterally about a pivot 36 (FIG. 4) on the movable bracket portion 33. The outboard motor 12 can be turned to starboard or port with respect to the boat body 11 by laterally moving the steering arm 35.

Figure 7:
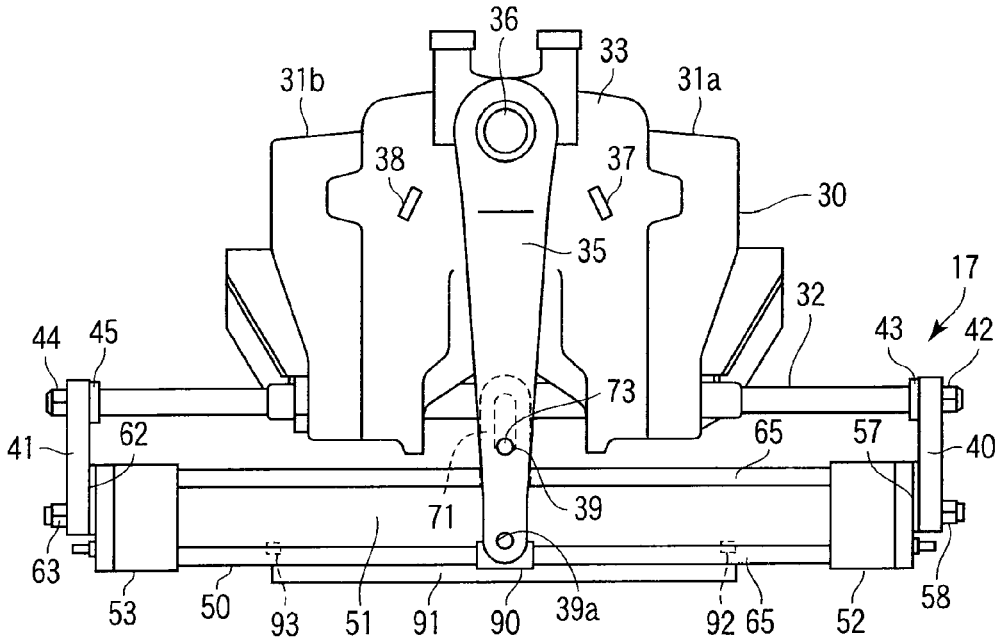
FIG. 7 is a plan view of the actuator unit and bracket shown in FIG. 3.
Figure 8:
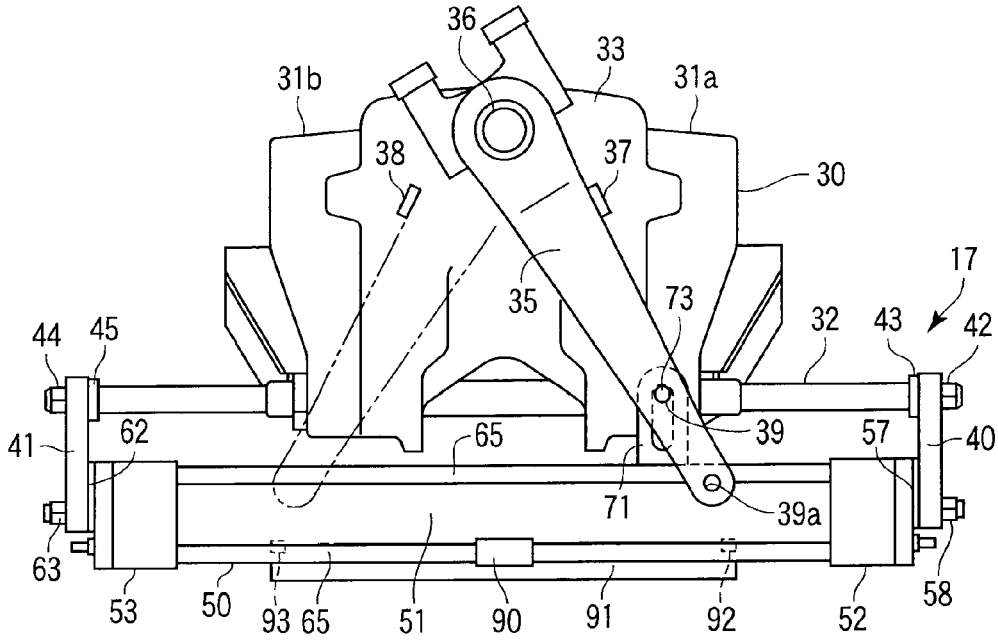
FIG. 8 is a plan view showing a state in which the actuator unit shown in FIG. 3 is on the starboard side.

FIG. 7 shows the steering arm 35 in a neutral position. When the steering arm 35 is in the neutral position, the outboard motor 12 is in its neutral position corresponding to a zero steering angle, so that the boat 10 goes straight. FIG. 8 shows the steering arm 35 on the starboard side. The steering arm 35 can be moved to port, as indicated by a two-dot chain line in FIG. 8. Stop portions 37 and 38 for regulating the maximum steering angle of the steering arm 35 are arranged on the upper surface of the movable bracket portion 33. A receiving portion 39 formed of, for example, a hole is disposed near the distal end portion of the steering arm 35.

The following is a description of the actuator unit 17.

The actuator unit 17 comprises a first support arm 40 and second support arm 41. The first support arm 40 is secured to one end of the tilting shaft 32 by a fastener 42 such as a nut. An elastic member 43 with a high spring constant, such as a coned disc spring, is interposed between the first support arm 40 and tilting shaft 32. The second support arm 41 is secured to the other end of the tilting shaft 32 by a fastener 44 such as a nut. An elastic member 45 with a high spring constant, such as a coned disc spring, is interposed between the second support arm 41 and tilting shaft 32.

Figure 9:
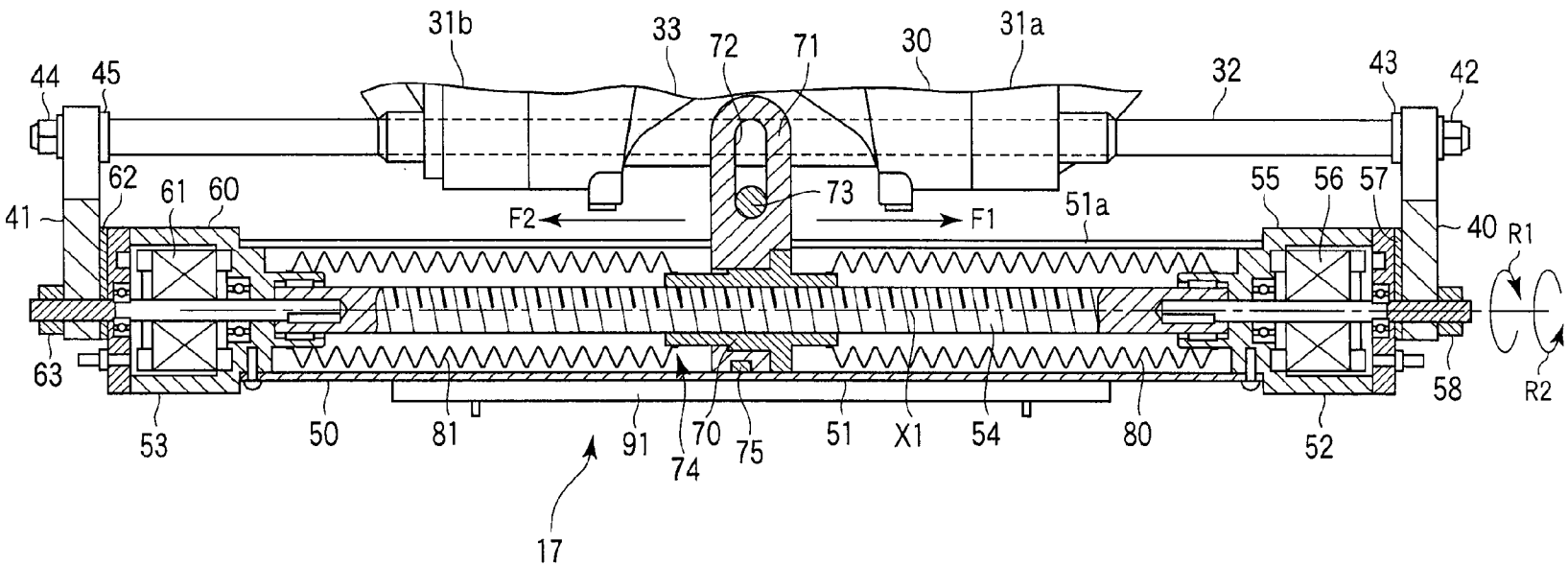
FIG. 9 is a horizontal sectional view of the actuator unit shown in FIG. 3.

The actuator unit 17 comprises an electric actuator 50. The electric actuator 50 is secured to the opposite end portions of the tilting shaft 32 by the first and second support arms 40 and 41. FIG. 9 shows a profile of the electric actuator 50. The electric actuator 50 comprises a cover member 51 extending transversely relative to the boat body 11, first electric motor 52, second electric motor 53, feed screw 54, nut member 70 (described later), etc. The first electric motor 52 is mounted near one end of the cover member 51. The second electric motor 53 is mounted near the other end of the cover member 51. The feed screw 54 is rotated by the electric motors 52 and 53. An example of the electric motors 52 and 53 is brushless DC motors that produce rotation in accordance with the number of pulses.

The cover member 51 of the present embodiment is in the form of a cylindrical guide pipe. This cover member 51 is disposed parallel to the tilting shaft 32. The cover member 51 is formed with a slot 51*a* extending along axis X1 of the feed screw 54.

As shown in FIG. 9, the first electric motor 52 comprises a motor body 55 and electrically rotatable rotor 56. The motor body 55 is secured to the first support arm 40 by a fastener 58 such as a nut so that an elastic member 57 with a high spring constant, such as a coned disc spring, is sandwiched between them.

The second electric motor 53 comprises a motor body 60 and electrically rotatable rotor 61. The motor body 60 is secured to the second support arm 41 by a fastener 63 such as a nut so that an elastic member 62 with a high spring constant, such as a coned disc spring, is sandwiched between them. As these electric motors 52 and 53 produce synchronous rotation in the same direction, torques can be applied from the opposite ends of the feed screw 54 to the feed screw 54.

Four connecting rods 65 are arranged parallel to one another between the motor body 55 of the first electric motor 52 and the motor body 60 of the second electric motor 53. These connecting rods 65 are located outside the cover member 51 and extend along axis X1 (FIG. 9) of the feed screw 54. The motor body 55 of the first electric motor 52 and the motor body 60 of the second electric motor 53 are connected to each other by these connecting rods 65.

The feed screw 54 is disposed inside the cover member 51. The feed screw 54 has axis X1 extending longitudinally relative to the cover member 51. This feed screw 54 can be rotated in first direction R1 or second direction R2 (FIG. 9) by torques produced by both the first electric motor 52 and second electric motor 53.

The nut member 70 is accommodated within the cover member 51. The nut member 70 comprises a spiral circulation path defined therein and a large number of balls that circulate in the circulation path. The nut member 70 is threadedly engaged with the feed screw 54 for rotation by means of the balls. If the feed screw 54 rotates relative to the nut member 70, the nut member 70 moves in accordance with the direction and degree of rotation of the feed screw 54. More specifically, the nut member 70 reciprocates in first direction F1 or second direction F2 (FIG. 9) along axis X1 within the cover member 51. The feed screw 54 and nut member 70 constitute a ball screw mechanism 74.

The nut member 70 is provided with a drive arm 71. The drive arm 71 moves integrally with the nut member 70 in first direction F1 or second direction F2 along the slot 51*a* in the cover member 51. Since the drive arm 71 moves along the slot 51*a*, the cover member 51 can prevent the drive arm 71 from rotating.

An engaging member 73 formed of, for example, a pin or bolt is introduced into a slot 72 in the drive arm 71. While the engaging member 73 is movable longitudinally relative to the drive arm 71 along the slot 72, it is kept from moving laterally. The drive arm 71 is provided with a magnet 75 (FIGS. 9 and 10) for use as a detected portion.

The engaging member 73 is connected to the receiving portion 39 of the steering arm 35. When the drive arm 71 moves in first direction F1 or second direction F2, the engaging member 73 moves in the same direction as the drive arm 71, whereupon the steering arm 35 moves to starboard or port. The steering arm 35 should be provided with another receiving portion 39*a* in a position different from that of the receiving portion 39, in order that it can deal with various boat bodies or outboard motors.

A pair of protective boots 80 and 81 are accommodated inside the cover member 51. The protective boots 80 and 81 consist mainly of synthetic resin or rubber. The one protective boot 80 is disposed between the first electric motor 52 and nut member 70. The other protective boot 81 is disposed between the second electric motor 53 and nut member 70. These protective boots 80 and 81 are in the form of bellows, which can expand and contract along axis X1 of the feed screw 54. The protective boots 80 and 81 cover the feed screw 54.

The actuator unit 17 of the present embodiment comprises a non-contact neutral position sensor 90, non-contact steering angle sensor 91, and sub-sensors 92 and 93. The sub-sensors 92 and 93 comprise Hall elements arranged at predetermined intervals within the range of movement of the drive arm 71. An example of the neutral position sensor 90 comprises a Hall element for detecting that the steering arm 35 is in the neutral position. When the steering arm 35 is in the neutral position, a signal indicative of the neutral position is output from the neutral position sensor 90 to the control unit 18. The neutral position sensor 90 also functions as a sub-sensor.

The steering angle sensor 91 can detect the steering angle of the steering arm 35 by detecting the magnet 75 attached to the drive arm 71. The steering angle sensor 91 outputs a signal (steering angle) corresponding to the position of the steering arm 35. The one sub-sensor 92 comprises a Hall element for detecting a maximum steering angle on the starboard side. The other sub-sensor 93 comprises a Hall element for detecting a maximum steering angle on the port side. The Hall element of the neutral position sensor 90 and the Hall elements of the sub-sensors 92 and 93 constitute a Hall element group.

The following is a description of the operation of the steering apparatus 13 with the above configuration.

When the helm 15 is turned, the degree of this turn (steering angle) is detected by the helm sensor 20, and electrical signals indicative of the direction and degree of steering angle are delivered to the control unit 18. The control unit 18 runs the first and second electric motors 52 and 53 so that a target steering angle output from the helm sensor 20 to the control unit 18 is equal to an actual steering angle of the outboard motor 12 detected by the steering angle sensor 91.

As the first and second electric motors 52 and 53 produce rotation in the same direction, the respective torques of the electric motors 52 and 53 are input to the feed screw 54 through the opposite ends of the feed screw 54. When the feed screw 54 rotates, the nut member 70 and drive arm 71 move in first direction F1 or second direction F2 (FIG. 9) in accordance with the degree and direction of rotation of the feed screw 54. The drive arm 71 moves transversely relative to the boat body 11 along axis X1 of the feed screw 54.

The position of the drive arm 71, that is, the steering angle of the steering arm 35, is detected by the steering angle sensor 91. The control unit 18 uses the neutral position of the steering arm 35, which is detected by the neutral position sensor 90, as a reference position of the steering angle. The electric motors 52 and 53 are controlled so that the actual steering angle of the steering arm 35 detected by the steering angle sensor 91 is equal to the target steering angle delivered from the helm sensor 20.

Figure 10:
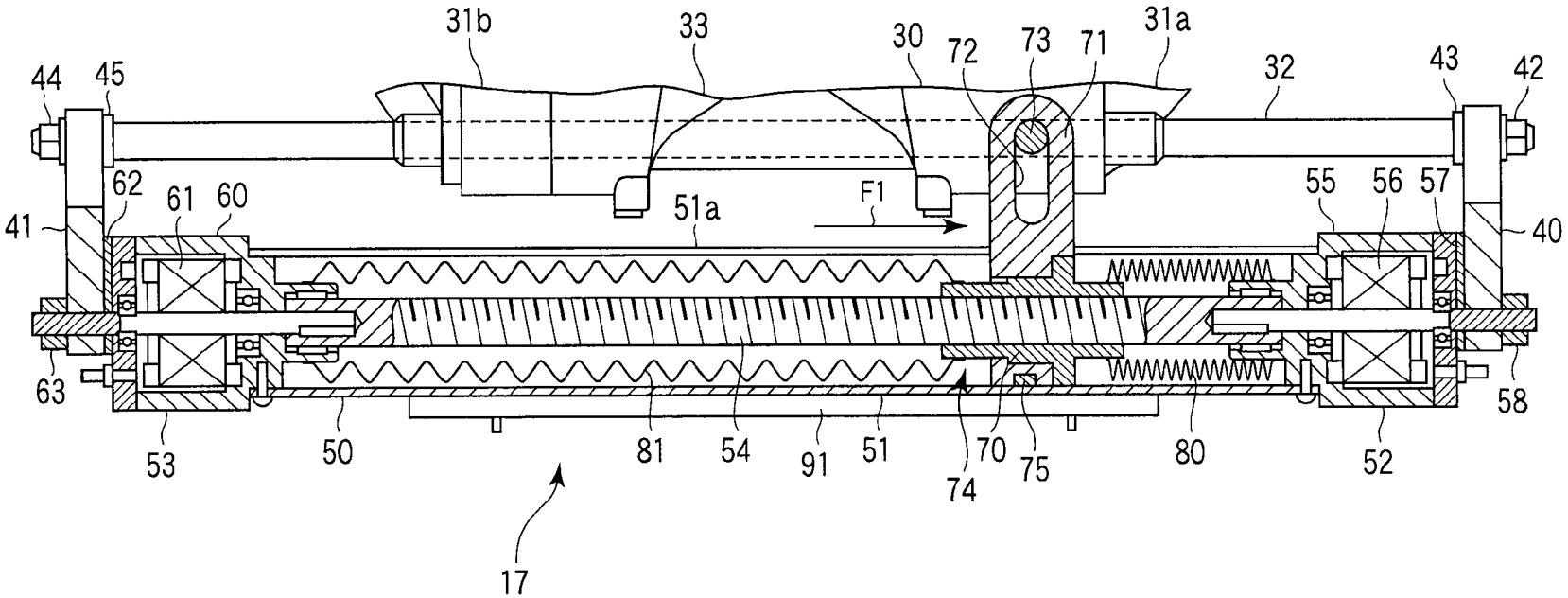
FIG. 10 is a sectional view showing a state in which the actuator unit shown in FIG. 3 is on the starboard side.

If the helm 15 is turned to starboard, for example, the first and second electric motors 52 and 53 produce rotation in first direction R1 (FIG. 9). Accordingly, the drive arm 71 moves in first direction F1, as shown in FIG. 10. When the steering angle detected by the steering angle sensor 91 becomes equal to the target steering angle, the first and second electric motors 52 and 53 stop, and the drive arm 71 also stops. As this is done, the one protective boot 80 contracts, while the other protective boot 81 expands.

If the helm 15 is turned to port, in contrast, the first and second electric motors 52 and 53 produce rotation in second direction R2. Accordingly, the drive arm 71 moves in second direction F2 (FIG. 9). When the steering angle detected by the steering angle sensor 91 becomes equal to the target steering angle, the first and second electric motors 52 and 53 stop, and the drive arm 71 also stops. As this is done, the one protective boot 80 expands, while the other protective boot 81 contracts.

The electric actuator 50 of the present embodiment is configured so that the pair of electric motors 52 and 53 input the torques to the feed screw 54 through the opposite ends of the feed screw 54. Therefore, the outside diameter of the feed screw 54 can be reduced compared with the case of a conventional actuator unit in which a feed screw is rotated by a single motor. Thus, the diameter of the electric actuator 50 can be reduced.

In addition, the feed screw 54, nut member 70, and protective boots 80 and 81 are concentrically arranged inside the cylindrical cover member (guide pipe) 51 that constitutes a part of the electric actuator 50. Therefore, the outside diameter of the electric actuator 50 can be prevented from increasing. Further, the first and second electric motors 52 and 53 are disposed individually at the opposite ends of the feed screw 54, and the respective torques of these electric motors 52 and 53 are transmitted directly to the feed screw 54. Thus, a power transmission mechanism and other members can be prevented from projecting outside the electric actuator 50.

For these reasons, the electric actuator 50 of the present embodiment can be formed in a compact manner. Accordingly, the electric actuator 50 can be prevented from interfering with the members of the boat body 11 when the outboard motor 12 is tilted up, as indicated by two-dot chain line A1 in FIG. 1. In addition, this system is a dual-motor system in which the feed screw 54 is rotated by the two electric motors 52 and 53. Even if one of the electric motors 52 and 53 breaks down, therefore, the feed screw 54 can be rotated by means of the other electric motor. Thus, a backup function can be achieved if there is any trouble between the electric motors 52 and 53.

Further, the protective boots 80 and 81 are entirely covered by the cover member 51. Therefore, contact between the protective boots 80 and 81 and cables, fuel supply pipe, etc., attached to the outboard motor 12, can be avoided, so that the protective boots 80 and 81 can be prevented from being damaged. Thus, the protective boots 80 and 81 can reliably protect a threaded joint between the feed screw 54 and nut member 70 from water and dust.

Depending on the oceanographic conditions or boat operating conditions, a heavy load may be suddenly applied to the outboard motor 12 while the boat 10 is sailing. If such an instantaneous load is applied to the outboard motor 12, an excessive load acts on the threaded joint between the feed screw 54 and nut member 70 and the like, resulting in an unfavorable effect. The actuator unit 17 of the present embodiment can absorb the instantaneous load in such a manner that the elastic members 43, 45, 57 and 62 on the support arms 40 and 41 are at least partially deformed when such a sudden external force is applied thereto. Thus, the feed screw 54, nut member 70, etc., can avoid receiving a sudden excessive load.

Figure 11:
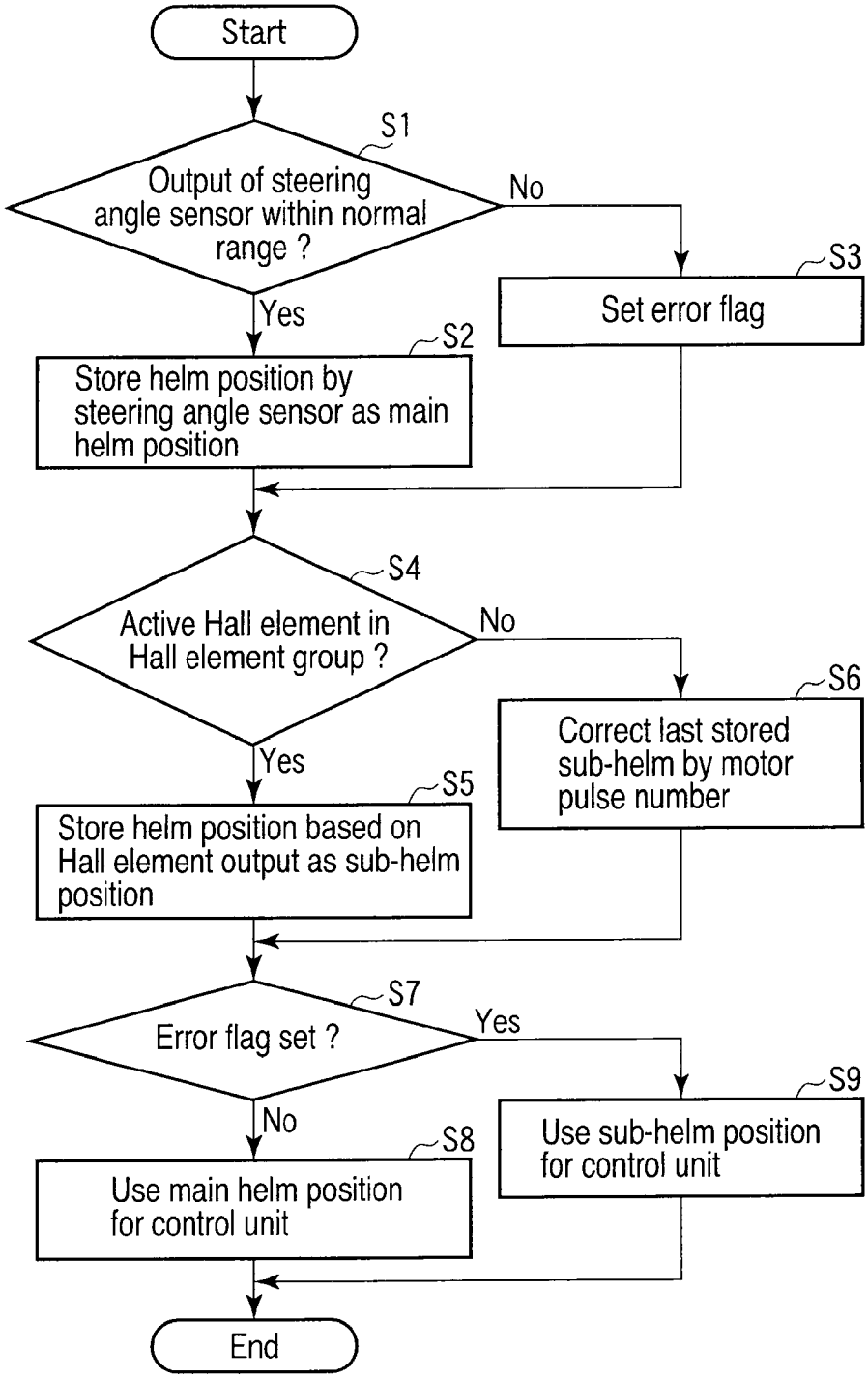
FIG. 11 is a flowchart showing steering angle detection processing of the actuator unit shown in FIG. 3.
Figure 12:
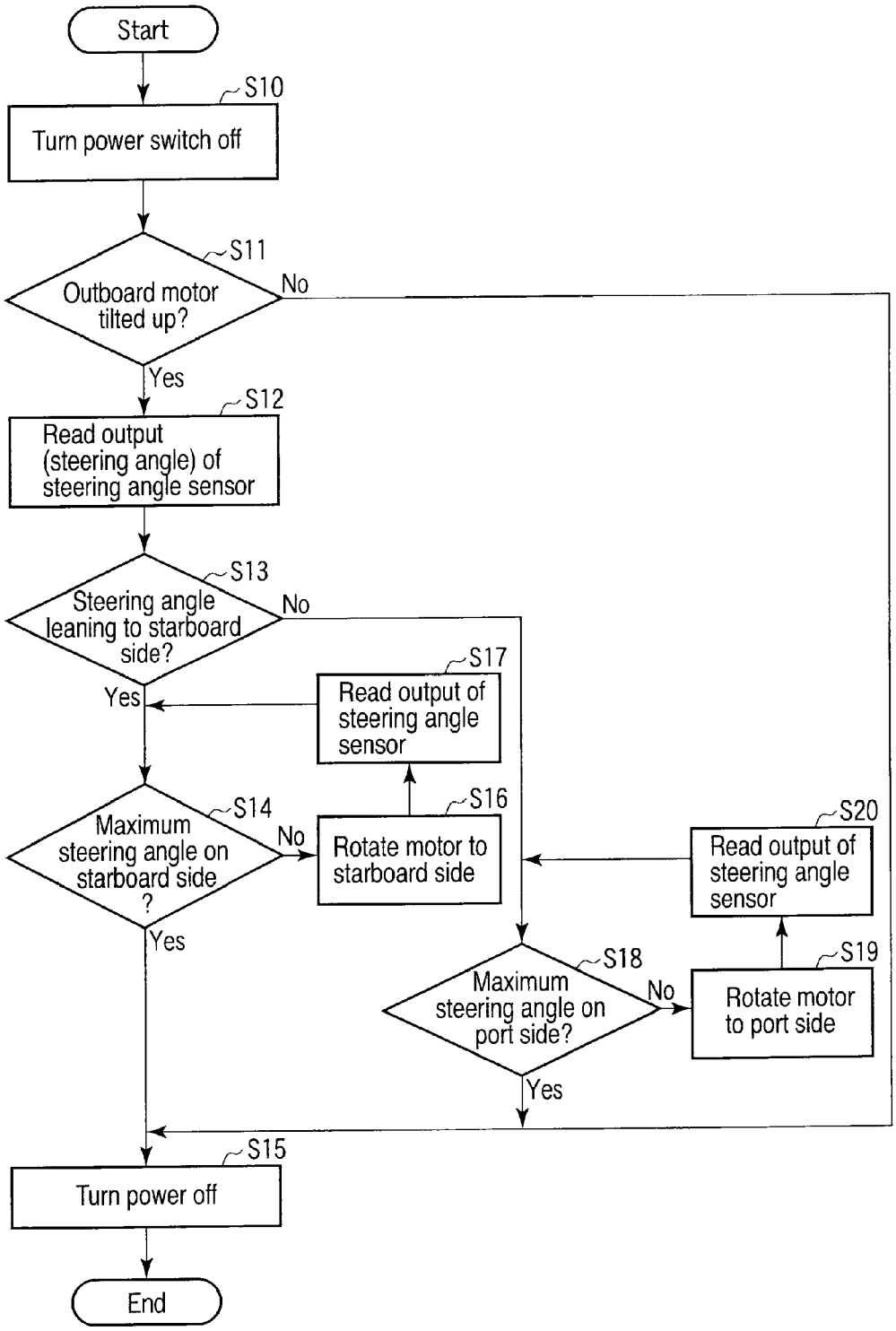
FIG. 12 is a flowchart showing power-off processing of the actuator unit shown in FIG. 3.

The control unit 18 of the steering apparatus 13 of the present embodiment comprises a computer program for performing steering angle detection processing shown in FIG. 11 and a computer program for performing power-off processing shown in FIG. 12. The steering angle detection processing will first be described with reference to FIG. 11.

In Step S1 in FIG. 11, it is determined whether or not the output of the steering angle sensor 91 is within a normal range. If the steering angle sensor 91 is determined to be normally functioning, the program proceeds to Step S2. If the steering angle sensor 91 is not normally functioning, the program proceeds to Step S3, in which an error flag is set.

In Step S2, a helm position (steering angle) detected by the steering angle sensor 91 is stored as a "main helm position" in a memory of the control unit 18, whereupon the program proceeds to Step S4. In Step S4, it is determined whether or not there is any active Hall element in the Hall element group. An example of the Hall element group is formed of the sensors 90, 92 and 93 comprising Hall ICs. If there is any active Hall element, the program proceeds to Step S5. If there is no active Hall element, the program proceeds to Step S6. In Step S5, a helm position (steering angle) based on the active Hall element is stored as a "sub-helm position" in the memory of the control unit 18. In Step S6, the last stored "sub-helm position" is corrected by the number of motor pulses output to the electric motors 52 and 53 and stored as a new "sub-helm position" in the memory of the of the control unit 18.

If it is determined in Step S7 that the error flag is not set, the program proceeds to Step S8. If the error flag is set, the program proceeds to Step S9. In Step S8, the control unit 18 controls the actuator unit 17 based on the "main helm position". In Step S9, the control unit 18 controls the actuator unit 17 based on the "sub-helm position".

In the case where the steering angle sensor 91 is normally functioning, as described above, the control unit 18 of the present embodiment controls the actuator unit 17 using the "main helm position" obtained by means of the steering angle sensor 91. If the steering angle sensor 91 is broken down, the "sub-helm position" is used to control the actuator unit 17. Thus, the steering safety of the boat 10 with the electric actuator unit 17 can be further improved.

The following is a description of the power-off processing shown in FIG. 12. This power-off processing is processing for avoiding the risk that the outboard motor 12 in a tilted-up state will unexpectedly fall on the starboard or port side by its own weight. In powering off the actuator unit 17, the power switch 19 (FIGS. 1 and 2) is turned off.

If the power switch 19 is turned off in Step S10, the program proceeds to Step S11. In Step S11, it is determined whether or not the outboard motor 12 is tilted up. Whether or not the outboard motor 12 is tilted up can be determined based on the output of a sensor (not shown) or the like for detecting the state of the tilt drive source.

If the tilted-up state is detected in Step S11, the program proceeds to Step S12. In Step S12, the output (steering angle signal) of the steering angle sensor 91 is read, whereupon the program proceeds to Step S13. In Step S13, it is determined, by the output of the steering angle sensor 91, whether or not the steering angle is leaning to the starboard side of the neutral position. If the steering angle is determined to be leaning to the starboard side, the program proceeds to Step S14.

In Step S14, it is determined whether or not the steering angle has the maximum value on the starboard side. If the steering angle has the maximum value on the starboard side, the outboard motor 12 is situated in a storage position on the starboard side, so that the program proceeds to Step S15, in which the power is turned off. If the steering angle is not determined to have the maximum value on the starboard side in Step S14, the program proceeds to Step S16. In Step S16, the electric motors 52 and 53 are made to produce further rotation to the starboard side. Thereafter, the output of the steering angle sensor 91 is read in Step S17, whereupon the program returns to Step S14.

If the steering angle is determined to be not leaning to the starboard side in Step S13, the program proceeds to Step S18. In Step S18, it is determined whether or not the steering angle has the maximum value on the port side. If the steering angle has the maximum value on the port side, the outboard motor 12 is situated in a storage position on the port side, so that the program proceeds to Step S15, in which the power is turned off. If the steering angle is not determined to have the maximum value on the port side in Step S18, the program proceeds to Step S19. In Step S19, the electric motors 52 and 53 are made to produce further rotation to the port side. Thereafter, the output of the steering angle sensor 91 is read in Step S20, whereupon the program returns to Step S18.

According to the power-off processing of the control unit 18 of the present embodiment, as described above, the outboard motor 12 in the tilted-up state can be forced to move to the storage position on the starboard or port side. Thus, the risk that the outboard motor 12 will unexpectedly fall on the starboard or port side by its own weight can be avoided, so that the safety in the tilted-up state can be further improved.

Figure 13:
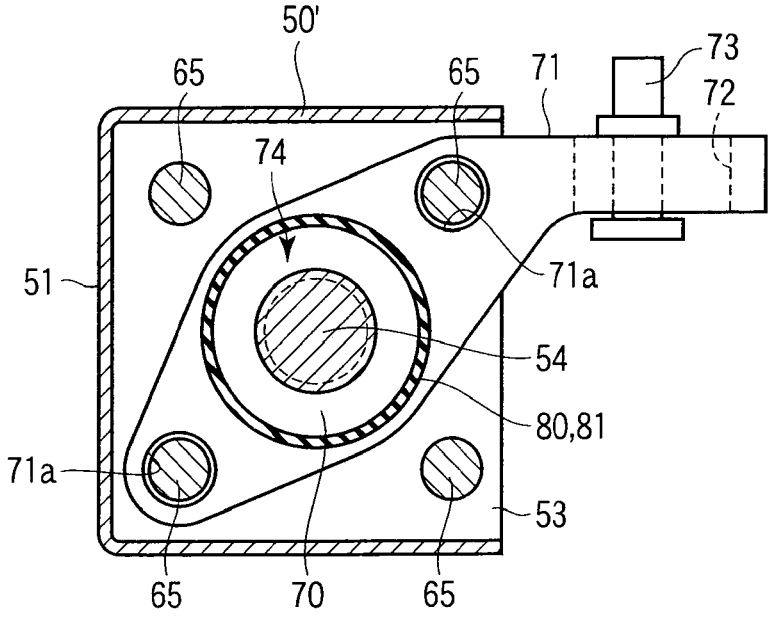
FIG. 13 is a sectional view of an actuator unit according to a second embodiment of the present invention along the radius of a feed screw.

FIG. 13 shows an electric actuator 50' according to a second embodiment of the present invention. A cover member 51 of the electric actuator 50' is disposed outside connecting rods 65. A feed screw 54, the connecting rods 65, and protective boots 80 and 81 are covered by the cover member 51. The feed screw 54 has an axis extending longitudinally relative to the cover member 51. A nut member 70 and drive arm 71 are prevented from rotating in such a manner that parts (e.g., through-holes) 71*a* of the drive arm 71 are fitted individually on the connecting rods 65. Since other configurations and functions are common to the electric actuator 50' and electric actuator 50 of the first embodiment, common numerals are used to designate their common parts, and a description thereof is omitted.

FIGS. 14 to 17 show an actuator unit 17A according to a third embodiment of the present invention. The actuator unit 17A comprises a neutral position locking mechanism 100A. The neutral position locking mechanism 100A is used to hold the outboard motor 12 in the neutral position in maintaining the outboard motor 12, for example. Since other configurations are common to a steering apparatus comprising the actuator unit 17A and steering apparatuses 13 of the first and second embodiments, common numerals are used to designate those parts shared with the first and second embodiments, and a description thereof is omitted.

Figure 14:
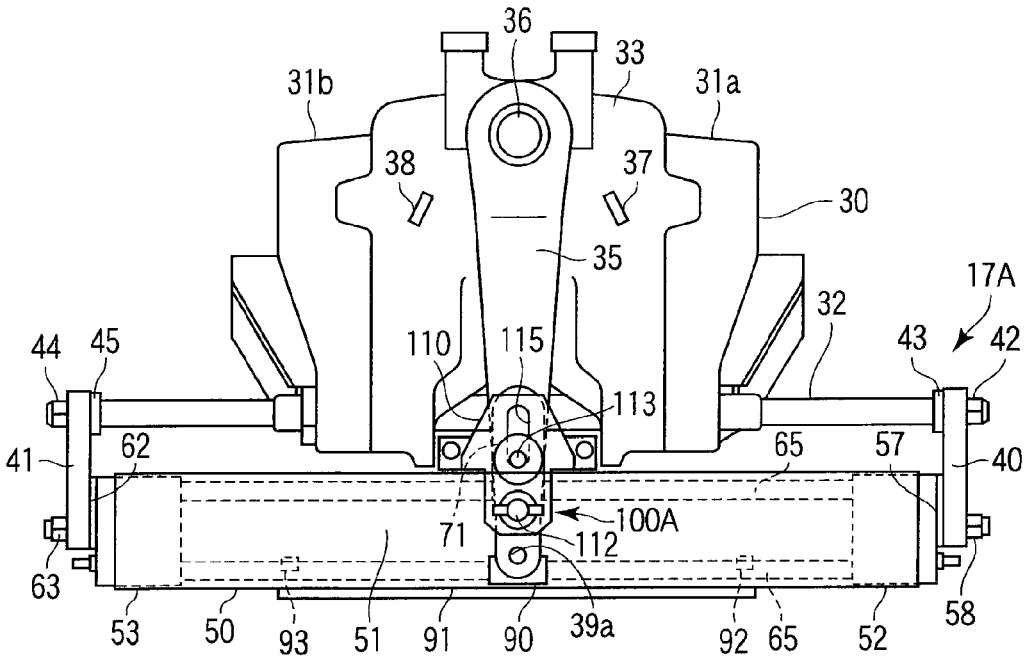
FIG. 14 is a plan view of an actuator unit with a neutral position locking mechanism according to a third embodiment of the present invention.
Figure 15:
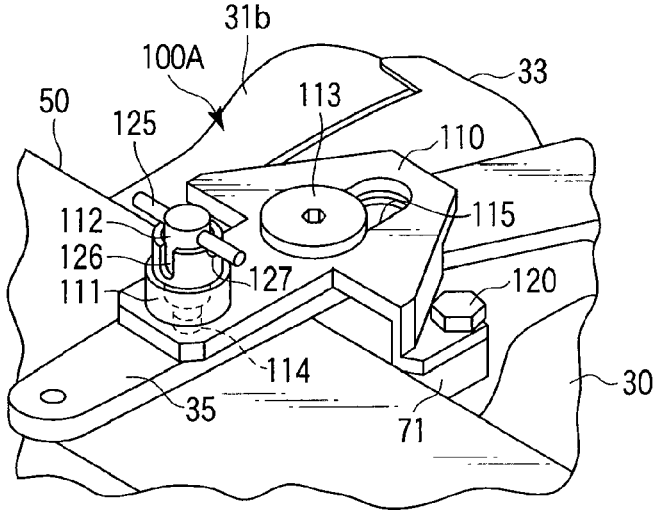
FIG. 15 is a perspective view showing an unlocked state of the neutral position locking mechanism shown in FIG. 14.
Figure 16:
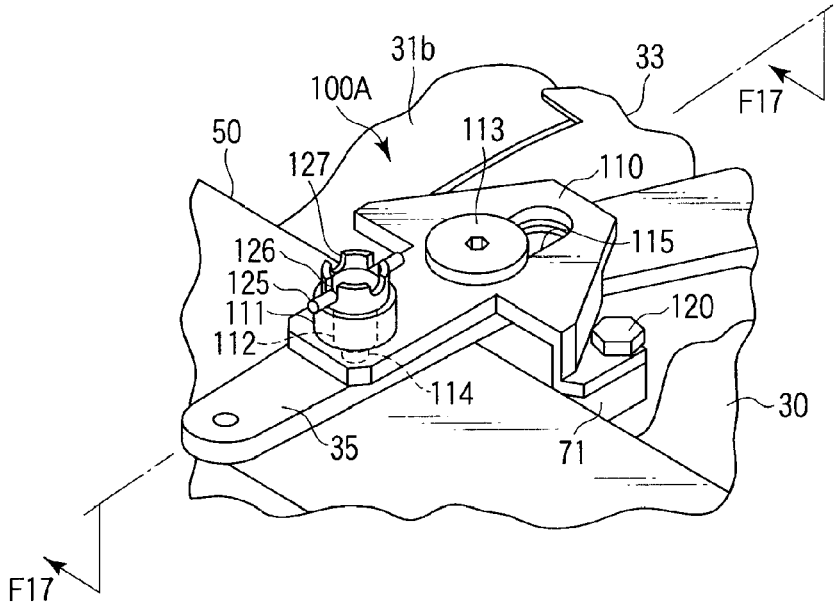
FIG. 16 is a perspective view showing a locked state of the neutral position locking mechanism shown in FIG. 14.
Figure 17:
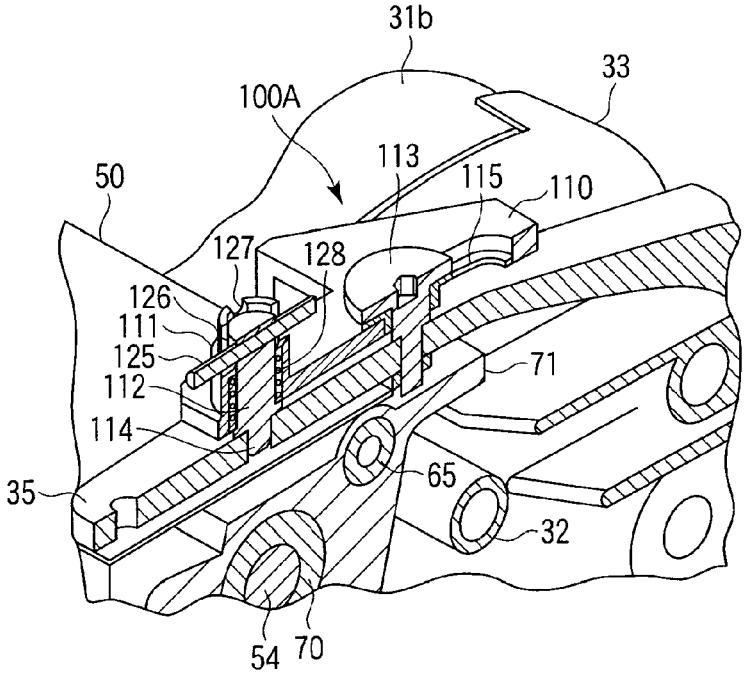
FIG. 17 is a sectional view of the neutral position locking mechanism taken along line F17-F17 in FIG. 16.

FIGS. 14 and 15 show an unlocked state of the neutral position locking mechanism 100A, and FIGS. 16 and 17 show a locked state. The neutral position locking mechanism 100A comprises a base member 110, lock pin guide 111, lock pin 112, engaging member 113, and lock hole 114 formed in a steering arm 35. The lock pin guide 111 is secured to the base member 110. The engaging member 113 is movable longitudinally relative to a boat body along a guide slot 115 formed in the base member 110. The base member 110 is secured to a drive arm 71 by a bolt 120. The steering arm 35 can pivot relative to the drive arm 71 and base member 110 about the engaging member 113.

The lock pin 112 comprises an operating portion 125 that can be manipulated with the fingers. A vertically extending slot 126 and recess 127 are formed at the upper end of the lock pin guide 111. The operating portion 125 can move vertically along the slot 126. The lock pin 112 is urged downwardly by a spring 128 (FIG. 17). If the operating portion 125 is manually pulled up and rotated 90° to engage with the recess 127, the lock pin 112 is kept off (or unlocked from) the lock hole 114. If the operating portion 125 is introduced into the slot 126, the lock pin 112 is fitted into the lock hole 114 by the spring 128, whereupon the locked state is established.

In the unlocked state shown in FIGS. 14 and 15, the lower end of the lock pin 112 is not fitted in the lock hole 114. Therefore, the steering arm 35 is allowed to pivot relative to the drive arm 71 and base member 110 about the engaging member 113. Thus, if electric motors 52 and 53 run so that the drive arm 71 moves to starboard or port, the outboard motor 12 moves to starboard or port.

In the locked state shown in FIGS. 16 and 17, the lower end of the lock pin 112 is fitted in the lock hole 114. Therefore, the steering arm 35 is secured to the base member 110 by the lock pin 112 and engaging member 113. Thus, the drive arm 71 is prevented from moving, so that the outboard motor 12 is held in the neutral position.

Figure 18:
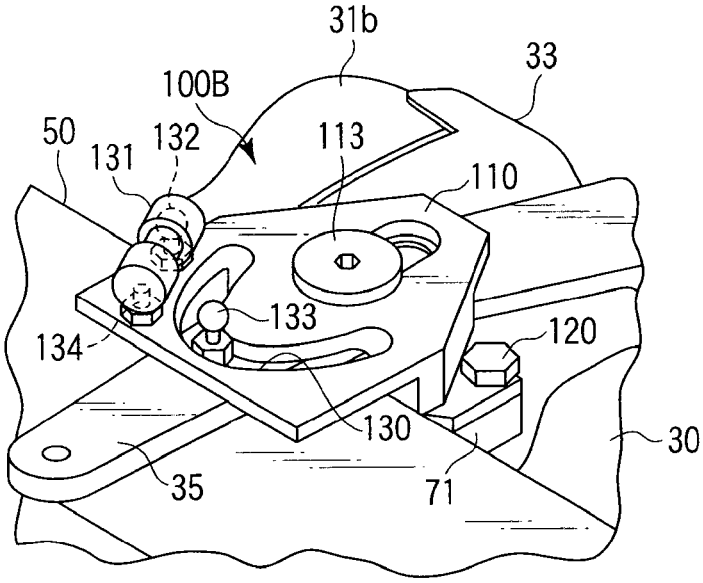
FIG. 18 is a perspective view showing an unlocked state of a neutral position locking mechanism according to a fourth embodiment of the present invention.
Figure 19:
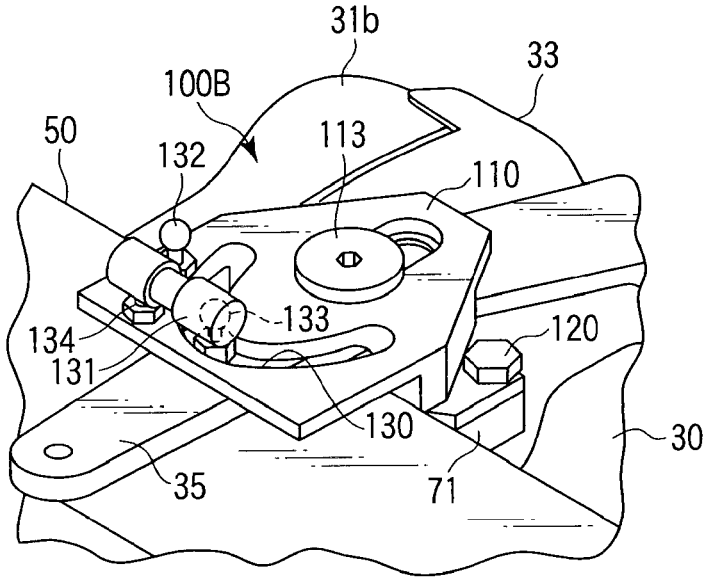
FIG. 19 is a perspective view showing a locked state of the neutral position locking mechanism shown in FIG. 18.

FIGS. 18 and 19 show a neutral position locking mechanism 100B according to a fourth embodiment of the present invention. FIG. 18 shows an unlocked state of the neutral position locking mechanism 100B, and FIG. 19 shows a locked state. The neutral position locking mechanism 100B comprises a base member 110 comprising an arcuate groove 130, joint member 131 on the base member 110, first ball stud 132 on the base member 110, and second ball stud 133 on a steering arm 35. The groove 130 is in the shape of a circular arc around an engaging member 113. The joint member 131 can turn around a shaft 134. The second ball stud 133 is movable along the groove 130. Other configurations are common to the neutral position locking mechanism 100B and the neutral position locking mechanism 100A of the third embodiment.

In the unlocked state shown in FIG. 18, the joint member 131 is held on the first ball stud 132. Therefore, the steering arm 35 is allowed to pivot relative to a drive arm 71 and the base member 110 about the engaging member 113. Thus, if electric motors 52 and 53 produce rotation such that the drive arm 71 moves to starboard or port, the outboard motor 12 moves to starboard or port.

In the locked state shown in FIG. 19, the joint member 131 is held on the second ball stud 133. Therefore, the steering arm 35 is secured to the base member 110 by the engaging member 113 and joint member 131. Thus, the drive arm 71 is prevented from moving, so that the outboard motor 12 is held in the neutral position.

Figure 20:
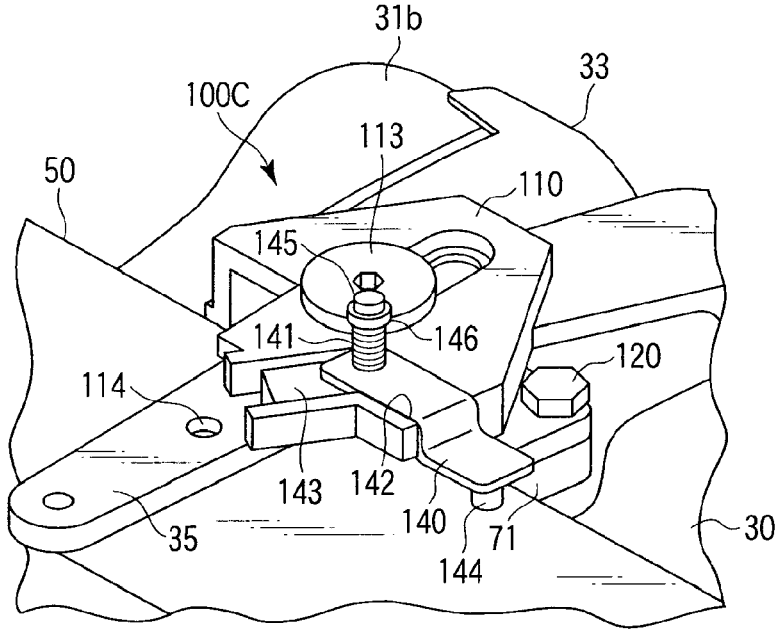
FIG. 20 is a perspective view showing an unlocked state of a neutral position locking mechanism according to a fifth embodiment of the present invention.
Figure 21:
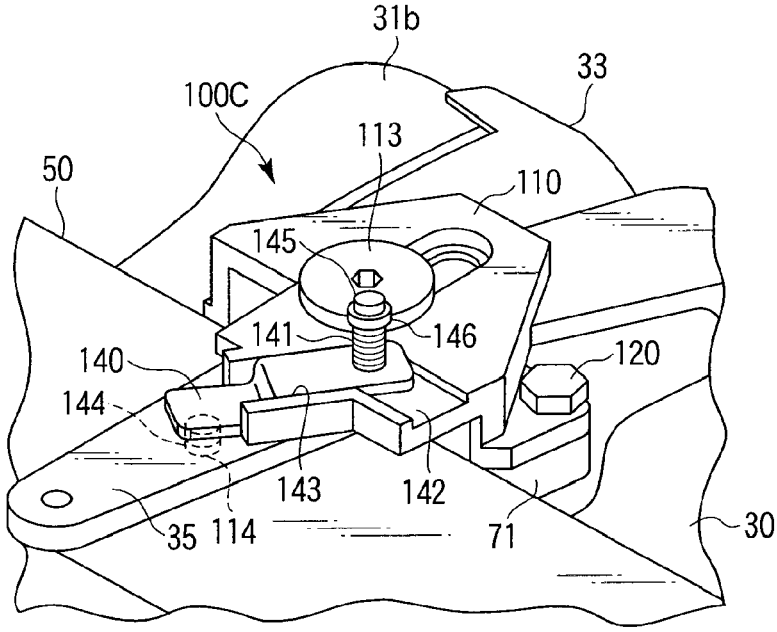
FIG. 21 is a perspective view showing a locked state of the neutral position locking mechanism shown in FIG. 20.

FIGS. 20 and 21 show a neutral position locking mechanism 100C according to a fifth embodiment of the present invention. FIG. 20 shows an unlocked state of the neutral position locking mechanism 100C, and FIG. 21 shows a locked state. The neutral position locking mechanism 100C comprises a swing arm 140 on a base member 110 and spring 141 that urges the swing arm 140 downward. A first holding portion 142 and second holding portion 143 are formed on the upper surface of the base member 110. The swing arm 140 comprises a lock pin 144 that can be fitted in a lock hole 114.

The swing arm 140 is swingable about a shaft 145 between a position (unlocked state) shown in FIG. 20 and position (locked state) shown in FIG. 21. An operating portion 146 is provided on the shaft 145. The swing arm 140 can be swung by manually pulling up the operating portion 146. Other configurations are common to the neutral position locking mechanism 100C and the neutral position locking mechanism 100A of the third embodiment.

In the unlocked state shown in FIG. 20, the swing arm 140 is fitted in the first holding portion 142, so that the lock pin 144 is not fitted in the lock hole 114. Therefore, a steering arm 35 is allowed to pivot relative to a drive arm 71 and the base member 110 about an engaging member 113. Thus, if electric motors 52 and 53 produce rotation such that the drive arm 71 moves to starboard or port, the outboard motor 12 moves to starboard or port.

In the locked state shown in FIG. 21, the swing arm 140 is fitted in the second holding portion 143, while the lock pin 144 is fitted in the lock hole 114. Therefore, the steering arm 35 is secured to the base member 110 by the engaging member 113 and swing arm 140. Thus, the drive arm 71 is prevented from moving, so that the outboard motor 12 is held in the neutral position.

The steering apparatus of the present invention is applicable to various types of boats with an outboard motor. It is to be understood, in carrying out the present invention, that the configurations and layouts of the outboard motor, steering arm, tilting shaft, etc., as well as of the cover member, first and second electric motors, feed screw, nut member, drive arm, protective boots, and support arms, which constitute the electric actuator, may be embodied in variously modified forms. Further, there are no restrictions on the forms of the boat body and outboard motor either.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A steering apparatus comprising an actuator unit configured to redirect a steering arm of an outboard motor, the actuator unit comprising:

first and second support arms supported on a bracket used to mount the outboard motor on a boat body;

a cover member disposed between the first and second support arms, the cover member having an axis extending longitudinally thereof;

a first electric motor disposed on one end of the cover member and secured to the first support arm, the first electric motor having a first rotor which is situated on the axis and which rotates around the axis;

a second electric motor disposed on the other end of the cover member and secured to the second support arm, the second electric motor having a second rotor which is situated on the axis and which rotates around the axis;

a feed screw disposed along the cover member inside the cover member and configured to be rotated by respective torques of the first and second electric motors;

a nut member threadedly engaged with the feed screw and configured to move along the axis inside the cover member as the feed screw rotates;

a drive arm attached to the nut member and configured to transmit the movement of the nut member along the axis to the steering arm, protective boots disposed inside the cover member and covering the feed screw in such a manner that the protective boots are capable of expanding and contracting along the axis; and connecting rods disposed outside the protective boots and extending along the axis, wherein the connecting rods connect the first and second electric motors, and are configured to prevent the drive arm from rotating and to guide the drive arm to move along the axis.

2. The steering apparatus according to claim 1, wherein the first and second support arms are mounted on a tilting shaft of the outboard motor and the actuator unit pivots downwardly about the tilting shaft with the outboard motor tilted up.

3. The steering apparatus according to claim 2, wherein elastic members are disposed between the tilting shaft and the first and second support arms.

4. The steering apparatus according to claim 2, wherein elastic members are disposed between the first and second electric motors and the first and second support arms.

5. The steering apparatus according to claim 1, wherein the actuator unit further comprises a neutral position sensor for detecting a neutral position of the steering arm.

6. The steering apparatus according to claim 1, wherein the actuator unit further comprises a steering angle sensor for detecting a position of the steering arm.

7. The steering apparatus according to claim 5, wherein the actuator unit further comprises a steering angle sensor for detecting a position of the steering arm.

8. The steering apparatus according to claim 1, further comprising:

a non-contact steering angle sensor configured to output a signal corresponding to a position of the drive arm;

a plurality of sub-sensors comprising Hall elements arranged at predetermined intervals within a range in which the drive arm moves; and a control unit configured to control the rotation produced by the first and second electric motors based on the output of the steering angle sensor when the output of the steering angle sensor is determined to be of a first state and control the rotation produced by the first and second electric motors based on outputs of the plurality of sub-sensors when the output of the steering angle sensor is determined to be of a second state.

9. The steering apparatus according to claim 1, further comprising:

a steering angle sensor configured to output a signal corresponding to a position of the drive arm;

a power switch configured to be operated in powering off the actuator unit; and a control unit configured to: (i) input a signal from a tilt-up sensor which determines whether or not the outboard motor is tilted up when the power switch is turned off, and (ii) if the outboard motor is tilted up, read a signal from the steering angle sensor, and drive the first and second electric motors to move the outboard motor to a maximum steering angle on one of a starboard side and a port side.

10. The steering apparatus according to claim 8, wherein the actuator unit further comprises a neutral position locking mechanism for locking the steering arm in a neutral position.

11. The steering apparatus according to claim 9, wherein the actuator unit further comprises a neutral position locking mechanism for locking the steering arm in a neutral position.

* * * * *